United States Patent [19]

Winter

[11] 4,413,807

[45] Nov. 8, 1983

[54] RAIL GAUGING SHOE

[76] Inventor: Edwin R. Winter, Rte. 75 and Shirley Rd., North Collins, N.Y. 14111

[21] Appl. No.: 305,936

[22] Filed: Sep. 28, 1981

[51] Int. Cl.[3] ..... B25B 1/20

[52] U.S. Cl. ..... 254/43

[58] Field of Search ..... 254/43-44; 269/249; 24/243 B; 294/103, 85; 238/218, 167

[56] References Cited

U.S. PATENT DOCUMENTS

| | | | |
|---|---|---|---|
| 688,106 | 12/1901 | Lynd . | |
| 888,931 | 5/1908 | Robinson | 24/243 B |
| 1,113,037 | 10/1914 | Montine | 238/218 |
| 1,247,224 | 11/1917 | Churchia | 254/44 |
| 1,522,788 | 1/1925 | Moltz | 254/43 |
| 1,598,212 | 8/1926 | Mahlmann | 254/43 |
| 1,620,906 | 3/1927 | Maher . | |
| 1,646,770 | 10/1927 | Shasteen . | |
| 1,939,480 | 12/1933 | Wilson . | |
| 1,984,650 | 12/1934 | McFadden . | |
| 2,204,395 | 6/1940 | Balcar | 238/218 |
| 2,586,282 | 2/1952 | Wren | 254/43 |
| 2,699,190 | 1/1955 | Packer | 269/249 |
| 3,246,867 | 4/1966 | Ewing | 24/243 B |
| 3,258,821 | 7/1966 | Curran | 24/243 B |
| 4,133,085 | 1/1979 | Hansson | 24/243 B |

FOREIGN PATENT DOCUMENTS

| | | | |
|---|---|---|---|
| 796535 | 4/1936 | France | 254/43 |
| 122769 | 8/1919 | United Kingdom | 24/243 B |

*Primary Examiner*—Robert C. Watson

*Attorney, Agent, or Firm*—Joseph P. Gastel

[57] ABSTRACT

A rail gauging shoe including a body portion, an elongated flat relatively thin top portion on the body portion for placement in contiguous relationship to the top of a rail, an elongated relatively thin first side portion extending transversely to the top portion for placement in contiguous relationship to the side of a rail facing another rail of a pair of railroad tracks, a second side portion extending transversely to the top portion on the opposite side thereof from the first side portion, first chamfered portions on the ends of the first portion, second chamfered portions at the ends of the second side portion, a plurality of screws extending through the second side portion for securing the body portion to a rail with the first side portion in abutting relationship to the rail, and a tongue extending outwardly from the first side portion for attachment to a pulling device.

10 Claims, 4 Drawing Figures

RAIL GAUGING SHOE

BACKGROUND OF THE INVENTION

The present invention relates to a rail gauging and straightening shoe for attachment to a deformed rail of a railroad track to return it to proper position.

By way of background, when there is a train derailment, one or both of the tracks become loosened from the ties on which they are mounted and they become deformed. In the past, one way of straightening the rails was to dig holes in the railroad bed, attach members to the rails, and pull them together. However, providing holes to receive the fastening members was awkward and laborious. In addition, pulling the rails by a member attached to the bottom frequently caused them to twist out of shape as they were pulled into position. Other types of rail gauging devices were of a nature that they had to be demounted from the rail after it was pulled back into position, so as to permit a train wheel to move along the track, and the rail often sprung out of gauge unless it was spiked to its ties. It is with overcoming the foregoing deficiencies of the prior art that the present invention is concerned.

SUMMARY OF THE INVENTION

It is one object of the present invention to provide a rail gauging shoe which can be mounted on a deformed rail to pull it back into proper gauged position, and which can remain in position to permit train wheels to pass along the track and over the shoe.

Another object of the present invention is to provide a rail gauging shoe which can be attached to a rail in an extremely simple and expedient manner. Other objects and attendant advantages of the present invention will readily be perceived hereafter.

The present invention relates to a rail gauging shoe comprising a body portion, an elongated top portion on said body portion for placement in contiguous relationship to the top of a rail, a side portion attached to said top portion for placement in contiguous relationship to the side of a rail facing another rail of a pair of railroad tracks, first attachment means on said body portion for securing said body portion to said rail, and second attachment means extending outwardly from said side portion for attachment to a pulling device. The various aspects of the present invention will be more fully understood when the following portions of the specification are read in conjunction with the accompanying drawings wherein:

DESCRIPTION OF THE PREFERRED EMBODIMENT

Figure 1:
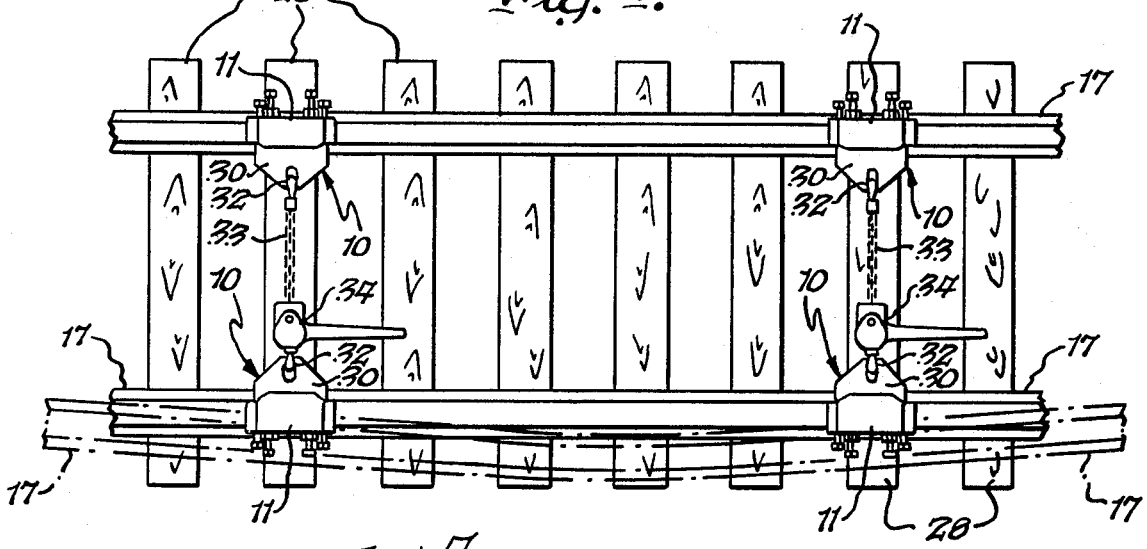
FIG. 1 is a fragmentary plan view showing a plurality of pairs of rail gauging shoes used for straightening a bent railroad track and bringing it back to proper gauge.
Figure 2:
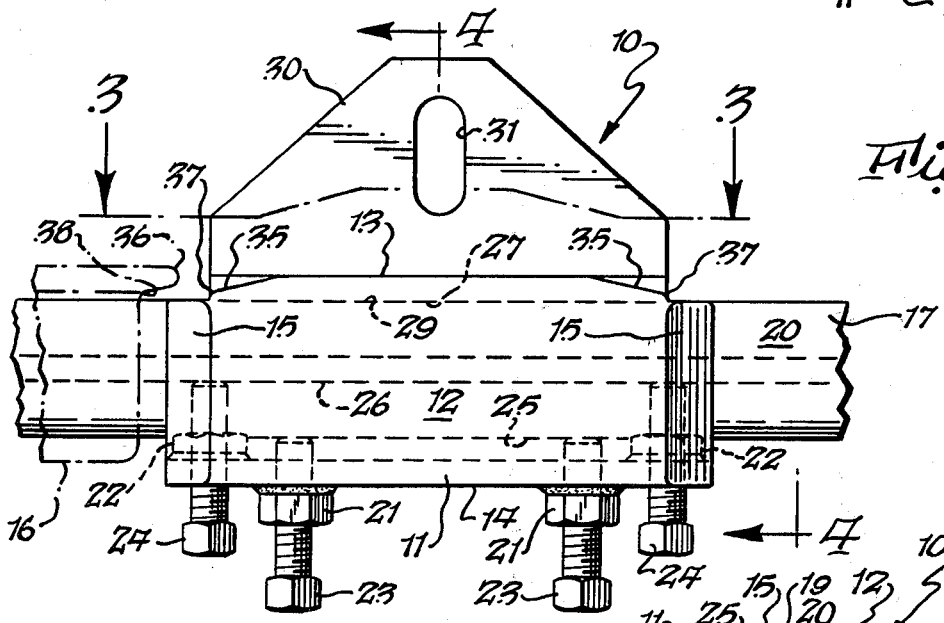
FIG. 2 is an enlarged fragmentary plan view of a rail gauging shoe mounted on a track and shown in relationship to a wheel of a railroad car.

Summarizing briefly in advance, the improved rail gauging shoe is used as described hereafter for the purpose of both bending a deformed railroad track and bringing it back to proper gauge to permit a train to pass over the track while the shoe is still attached to the track.

The improved shoe 10 includes a body portion 11 having a top portion 12 and depending side portions 13 and 14. Top portion 12 is essentially a relatively thin flat member having chamfers 15 at opposite ends, which will essentially provide ramps for railroad car wheel 16 to move across top portion 12 without creating too much of a "bump" when shoe 10 is mounted in position on rail 17. As can be seen from FIG. 4, the underside 19 of top portion 12 fits firmly onto the top 20 of rail 17.

Side 14 includes a first pair of nuts 21 welded to the outside thereof and a second pair of nuts 22 welded to the inside thereof. All of the nuts are in line with bores (not numbered) in wall 14 so as to permit screws 23 and 24 to pass through side 14. When screws 23 are tightened, their ends will abut side 25 of the upper thicker portion of rail 17. When screws 24 are tightened, their ends will abut side 26 of the lower narrower portion of rail 17. Thus, by tightening screws 23 and 24, the inside surface 27 of side 13 will be caused to move into tight abutting relationship with side 29 of rail 17. In addition, since screws 23 and 24 are tightened when top portion 12 is in abutting engagement with the top portion 20 of rail 17, screws 23 and 24 will thus fix shoe 10 in position.

A tongue 30 is formed integrally with side 13 and extends substantially perpendicularly thereto at an elevation well below the level of top portion 12. A hole 31 is provided in tongue 30 for receiving a hook 32 which may be attached to a chain 33 of a "come-along hoist" or a "ratchet chain binder" 34.

In use, a pair of shoes 10 may be attached to spaced rails 17, one of which may have been bent outwardly as shown in dotted lines in FIG. 1 because of a derailment. After the shoes 10 are secured by screws 23 and 24 and tongue 30 is attached to a ratchet chain binder 34 by means of chains and hooks, the ratchet chain binder is activated to pull the formerly bent rail 17 to its solid-line position in FIG. 1 on ties 28. The exact spacing between rails 17 is determined by means of a suitable gauge.

A train may move along rails 17 while shoes 10 remain in position. This is possible because the above chamfered ends 15 will lessen the bumping as the train wheel 16 passes over the top portion 12. In addition, the ends of sides 13 are chamfered at 35 so that the flange 36 of wheel 16 will not catch on the end of side 13. Furthermore, the junction 37 (FIG. 4) between sides 12 and 13 is rounded to essentially match the zone 38 of wheel 16 at which flange 36 joins the remainder of the wheel.

Figure 3:
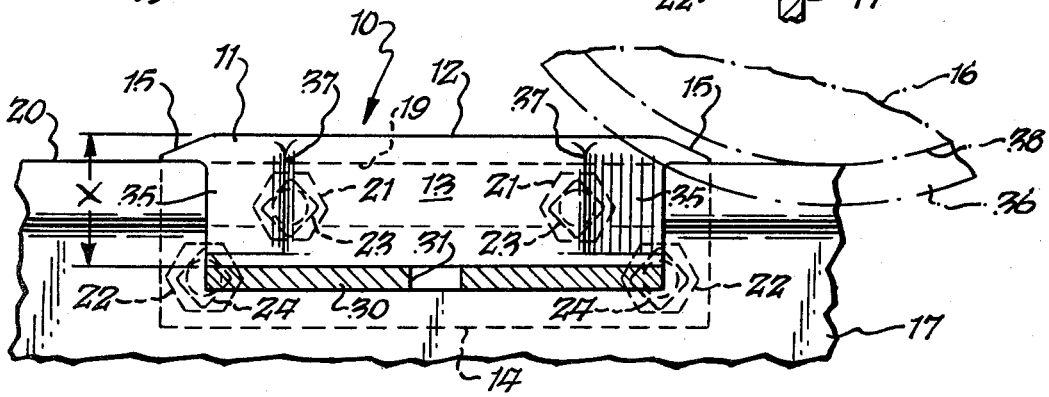
FIG. 3 is a fragmentary cross sectional view taken substantially along line 3—3 of FIG. 2.

The vertical height X (FIG. 3) is greater than the height of flange 36 so that there will be a clearance between this flange and the top surface of tongue 30. This structural feature, in combination with the above described structural features, permit the shoes 10 to remain in place as a temporary expedient to maintain the spacing between rails 17 at a proper value. Thus, the track can be used with the shoes mounted thereon until it is permanently repaired. It will be appreciated that if the shoes 10 were removed after the rail 17 was straightened, there would always be the possibility that the formerly bent rail 17 could spring back to an out-of-gauge position. In certain instances it may not even be necessary to use spikes to hold the formerly bent rail in position, as the shoes 10 will serve as a temporary expedient in this regard.

Figure 4:
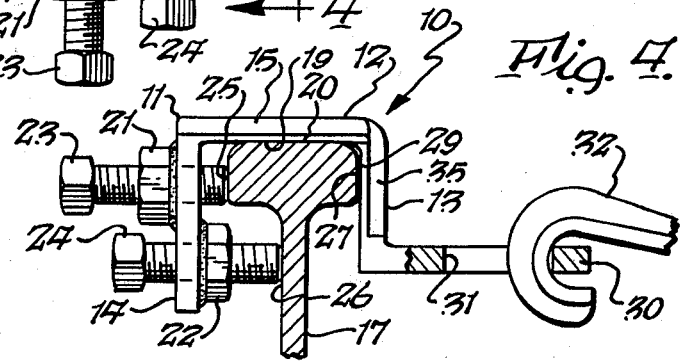
FIG. 4 is a fragmentary cross sectional view taken substantially along line 4—4 of FIG. 2.

In addition to the foregoing, in certain instances the former rebent rail 17 will not only have bent outwardly, but will have also been pivoted about its longitudinal axis so that the upper portion lies outwardly of the lower portion. By attaching the shoe 10 to the upper portion, as shown in FIG. 4, when the ratchet chain binder is actuated, the shoe will tend to pivot rail 17 back to an upright position because the pulling force is applied to the top of the rail.

It will be appreciated that the use of shoes 10 in the manner described above is a temporary expedient to permit rails to be brought back to gauge so that the track can be used temporarily until it is repaired. It will be appreciated that when a train passes over shoes 10, it must move at a relatively low speed to avoid excessive bumping shock.

The shoe 10 is fabricated of cast steel. By way of dimensions, it is 12 inches long, 4 inches high, and 4½ inches wide exclusive of the tongue. The drawings are essentially to scale so that the other dimensions can be taken therefrom.

While a preferred embodiment of the present invention has been disclosed, it will be appreciated that it is not limited thereto but may be otherwise embodied within the scope of the following claims.

What is claimed is:

1. A rail gauging shoe for mounting on a deformed rail of a pair of railroad tracks to pull it back into proper gauged position relative to the other rail of said pair of railroad tracks and which can remain in position to permit train wheels to pass along the deformed rail and over the rail gauging shoe comprising a body portion, an elongated flat top portion on said body portion for placement in contiguous abutting relationship to the top of said deformed rail, an elongated first side portion extending transversely to said top portion for placement in contiguous relationship to the side of said deformed rail facing said other rail of said pair of railroad tracks, first chamfered portions at the ends of said top portion, second chamfered portions at the ends of said first side portion, a second side portion extending transversely to said top portion on the opposite side thereof from said first side portion, first attachment means on said second side portion for securing said body portion to said rail with said first side portion in abutting relationship to said rail, and second attachment means on said first side portion for attachment to a pulling device.

2. A rail gauging shoe as set forth in claim 1 wherein said second attachment means extend outwardly from said first side portion at an elevation sufficiently below said top portion so as to be clear of an outer edge of a train wheel passing over said top portion.

3. A rail gauging shoe as set forth in claim 2 wherein said second attachment means comprises a tongue.

4. A rail gauging shoe as set forth in claim 3 including a hole in said tongue for receiving hook means.

5. A rail gauging shoe as set forth in claim 1 including a rounded portion at the junction of said top portion and said first side portion.

6. A rail gauging shoe as set forth in claim 1 wherein said first attachment means comprise a plurality of screws threaded into said second side portion for engaging the outside of said rail.

7. A rail gauging shoe as set forth in claim 6 wherein said rail comprises an upper portion and a thinner lower portion, and wherein said plurality of screws comprises a first pair of screws for engaging said upper portion, and a second pair of screws for engaging said lower portion.

8. A rail gauging shoe as set forth in claim 6 wherein said second attachment means extend outwardly from said first side portion at an elevation sufficiently below said top portion so as to be clear of an outer edge of a train wheel passing over said top portion.

9. A rail gauging shoe as set forth in claim 8 wherein said second attachment means comprises a tongue.

10. A rail gauging shoe combination for mounting on a deformed rail and the other rail of a pair of railroad tracks for pulling said deformed rail back to proper gauged position relative to said other rail and which can remain in position to permit train wheels to pass over the gauging shoe combination mounted on said deformed rail and said other rail comprising first and second rail gauging shoes each having a body portion, an elongated flat top portion on each of said body portions for placement in contiguous abutting relationship to the tops of said deformed rail and said other rail, an elongated first side portion on each of said rail gauging shoes for placement in contiguous relationship to the side of said deformed rail facing said other rail and the side of said other rail facing said deformed rail, first chamfered portions at the ends of said top portions, second chamfered portions at the ends of said first side portions, second side portions extending transversely to said top portions on the opposite sides thereof from said first side portions, first attachment means on said second side portions for securing said body portions to said rails with said first side portions in abutting relationship to said rails, tongues extending outwardly from said first side portions and located sufficiently below said elongated flat top portions to be clear of train wheels on said top portions, second attachment means on said tongues for attachment to a pulling device, and a pulling device secured to said tongues for pulling said deformed rail back to proper gauged position relative to said other rail with said first and second rail gauging shoes remaining in position on said rails to hold said rails in position relative to each other while permitting train wheels to pass thereover.

* * * * *